US006820961B2

(12) United States Patent
Johnson

(10) Patent No.: US 6,820,961 B2
(45) Date of Patent: Nov. 23, 2004

(54) STATIONARY INK MIST CHIMNEY FOR INK JET PRINTER

(75) Inventor: Martin Alan Johnson, Winchester, KY (US)

(73) Assignee: Lexmark International, Inc., Lexington, KY (US)

( * ) Notice: Subject to any disclaimer, the term of this patent is extended or adjusted under 35 U.S.C. 154(b) by 127 days.

(21) Appl. No.: 10/185,176

(22) Filed: Jun. 28, 2002

(65) Prior Publication Data

US 2004/0001119 A1 Jan. 1, 2004

(51) Int. Cl.[7] ..... B41J 2/165
(52) U.S. Cl. ..... 347/36; 347/29; 347/34
(58) Field of Search ..... 347/36, 34, 29

(56) References Cited

U.S. PATENT DOCUMENTS 4,369,450 A * 1/1983 Iwagami et al. ..... 347/34
6,017,111 A * 1/2000 Kurata ..... 347/34
6,220,314 B1 * 4/2001 Sato ..... 141/351
6,464,328 B1 * 10/2002 Hiramatsu et al. ..... 347/34
6,561,621 B2 * 5/2003 Webster ..... 347/34

* cited by examiner

*Primary Examiner*—Shih-Wen Hsieh
(74) *Attorney, Agent, or Firm*—Taylor & Aust, P.C.

(57) ABSTRACT

An ink collection assembly includes an ink collection chimney defined, at least in part, by a tubular. The tubular structure has a proximal end and a distal end. The tubular structure extends from the proximal end a first distance to the distal end. The distal end defines an opening for receiving waste ink. A hydrophobic foam is positioned in the tubular structure. With the hydrophobic foam positioned in the tubular structure, the tubular structure includes a hollow portion located between the hydrophobic foam and the proximal end.

36 Claims, 4 Drawing Sheets

STATIONARY INK MIST CHIMNEY FOR INK JET PRINTER

BACKGROUND OF THE INVENTION

1. Field of the Invention

The present invention relates to an ink jet printer, and, more particularly, to a device for collecting waste ink in an ink jet printer.

2. Description of the Related Art

During printing with an ink jet printer, an ink jet printhead ejects very tiny ink droplets in order to provide the best print quality. The ink droplets are so small that if they do not impact a surface within a short distance of leaving the nozzles, they tend to drift away in a cloud of mist. During the printing of the ejected ink droplets onto a sheet of print medium, such as paper, ink mist drifting is not an issue because the paper is only about 1.00 mm to 1.25 mm away from the printhead. However during an ink spit maintenance operation performed in a maintenance cycle for the printhead, typically there is a much greater distance to cover before the ink reaches the features designed to receive the ejected ink on the maintenance sled. In this empty space, an ink mist cloud can form and float into other areas of the printer. Over time, this ink misting collects on the inside of the covers, some even escaping through holes in the printer covers to form splotches on the outside of the covers.

One attempt to reduce ink misting is to provide a rotating drum in order to give the ink a place to collect. The drum turns so that the ink drips off into an ink well and a clean surface is positioned for the next spit. It is also possible to disable the mechanism for the drum rotation, and to allow the ink to drip around the sides as it collects on the top. In general, however, the drum provides a curved surface, concave down, that the ink strikes and then runs off, to be collected beneath the drum for evaporative dispersion. Such rotating and stationary drums are attached to the maintenance sled.

It is also known to provide the maintenance sled with a chimney into which the spit ink can be directed. The chimney is intended to surround the ink mist cloud and thereby prevent its movement into other areas of the printer. The ink mist collects on the inside walls of the chimney and flows down toward an ink collection area underneath the sled. Such chimneys are affixed to the maintenance sled.

The above-referenced drum and chimney configurations must be designed such that, as the maintenance sled moves upward, the top of the drum or chimney does not physically contact or otherwise interfere with the printhead. Thus, the top of the drum or chimney must be maintained at a distance during the spitting of the printhead that is equal to the vertical distance the sled travels before other maintenance functions are performed, such as capping. A problem with this implementation of the drum or chimney is that with this rather large gap, the mist cloud is not completely captured in the chimney or collected by the drum, and can escape the maintenance area.

What is needed in the art is a device for preventing the drifting of a cloud of ink mist after a spit maintenance operation of an ink jet printhead.

SUMMARY OF THE INVENTION

The present invention provides a device for reducing or preventing the drifting of a cloud of ink mist after a spit maintenance operation of an ink jet printhead.

In one form thereof, the invention relates to an ink collection assembly. The ink collection assembly includes an ink collection chimney defined, at least in part, by a tubular structure. The tubular structure has a proximal end and a distal end. The tubular structure extends from the proximal end a first distance to the distal end. The distal end defines an opening for receiving waste ink. A hydrophobic foam is positioned in the tubular structure. With the hydrophobic foam positioned in the tubular structure, the tubular structure includes a hollow portion located between the hydrophobic foam and the proximal end.

In another form thereof, the invention relates to an ink jet printer. The ink jet printer includes a frame and a printhead carrier system coupled to the frame. The printhead carrier system includes a printhead carrier for carrying at least one printhead. An ink collection chimney is defined, at least in part, by a tubular structure, and has a proximal end and a distal end. The proximal end of the tubular structure is coupled to the frame. The tubular structure extends from the proximal end a first distance to the distal end. The distal end defines an opening for receiving waste ink from the at least one printhead. A hydrophobic foam is positioned in the tubular structure. The tubular structure includes a hollow portion located between the hydrophobic foam and the proximal end.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate preferred embodiments of the invention, and such exemplifications are not to be construed as limiting the scope of the invention in any manner.

DETAILED DESCRIPTION OF THE INVENTION

Figure 1:
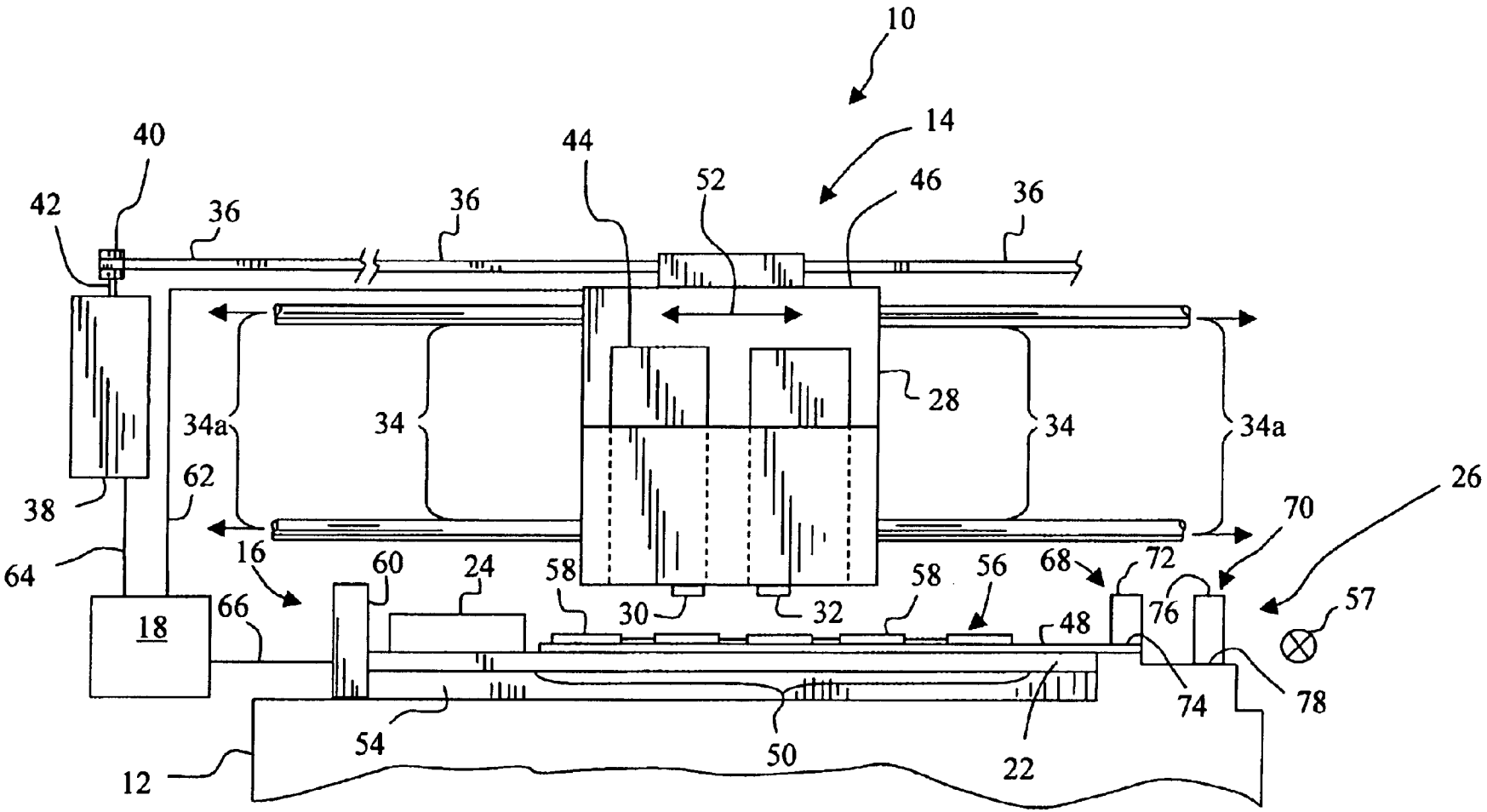
FIG. 1 is a pictorial representation of a portion of an ink jet printer including one embodiment of the present invention.

Referring now to the drawings, and particularly to FIG. 1, there is shown a printer 10 including a printer frame 12, a printhead carrier system 14, a media sheet feed system 16, a controller 18, a mid-frame 22, a maintenance wiper and capping station 24, and a waste ink collection device 26. Each of printhead carrier system 14, media sheet feed system 16, controller 18, mid-frame 22, maintenance wiper and capping station 24, and waste ink collection device 26 is coupled, either directly or indirectly, to printer frame 12.

Printhead carrier system 14 includes a printhead carrier 28 for carrying a color printhead 30 and a mono, e.g., black, printhead 32, and a pair of guide rods 34.

Printhead carrier system 14 is guided by the pair of guide rods 34. The axes 34*a* of guide rods 34 define a bi-directional scanning path for printhead carrier 28, and thus, for convenience the bidirectional scanning path will be referred to as bidirectional scanning path 34*a*. Printhead carrier 28 is connected to a carrier transport belt 36 that is driven by a carrier motor 38 via drive pulley 40 to transport printhead carrier 28 in a reciprocating manner along guide rods 34. Carrier motor 38 can be, for example, a direct current (DC) motor or a stepper motor. Carrier motor 38 has a rotating carrier motor shaft 42 that is attached to drive pulley 40.

A color ink reservoir 44 is provided in fluid communication with color printhead 30, and a black ink reservoir 46 is provided in fluid communication with black printhead 32. Printhead carrier system 14 and printheads 30, 32 may be configured for unidirectional printing or bi-directional printing.

The reciprocation of printhead carrier 28 transports ink jet printheads 30, 32 across a print medium sheet 48, such as paper, along bi-directional scanning path 34*a* to define a print zone 50 of printer 10. This reciprocation occurs in a main scan direction 52 that is parallel with bi-directional scanning path 34*a*, and is also commonly referred to as the horizontal direction. During each scan of printhead carrier 28, print medium sheet 48 is held stationary by media sheet feed system 16.

Media sheet feed system 16 includes an index roller 54 and a corresponding index pinch roller assembly 56, including a plurality of pinch rollers 58. An exit roller unit (not shown) may be provided to supplement media sheet feed system 16 in transporting print medium sheet 48 through print zone 50. In the embodiment shown, index roller 54 is driven by a drive unit 60 to transport print medium sheet 48 in a sheet feed direction 57, depicted by an "X" representing that the direction of travel is from the plane of FIG. 1 toward the reader. Pinch rollers 58 are idler rollers, and apply a biasing force to hold print medium sheet 48 in contact with driven index roller 54. Drive unit 60 includes a drive source, such as a stepper motor, and an associated drive mechanism, such as a gear train or belt/pulley arrangement.

Controller 18 is electrically connected to printheads 30, 32 via a printhead interface cable 62. Controller 18 is electrically connected to carrier motor 38 via interface cable 64. Controller 18 is electrically connected to drive unit 60 via interface cable 66.

Controller 18, which includes a microprocessor, with associated random access memory (RAM) and read only memory (ROM), executes program instructions to effect the generation of control signals which are supplied to printhead carrier system 14 and media sheet feed system 16 to effect the printing of an the image on print medium sheet 48, such as paper.

Maintenance wiper and capping station 24 operates in a well known manner, which can be briefly summarized as follows. Maintenance wiper and capping station 24 includes (not shown) a maintenance sled that is movable relative to printer frame 12 in both a horizontal direction and a vertical direction. Attached to the maintenance sled is a pair of printhead caps, and a pair of printhead wipers. During a wiping operation, the wipers are raised to a height to permit contact with printheads 30, 32. As printhead carrier 28 is moved over maintenance wiper and capping station 24, the pair of wipers clean, by wiping, the external surface of printheads 30, 32, respectively. During a capping operation, the pair of printhead caps is raised to a height to cover and seal around with printheads 30, 32, respectively. For performing a printhead spit maintenance operation, however, carrier 28 is transported across print zone 50, to waste ink collection device 26.

In the embodiment shown, waste ink collection device 26 is located such that print zone 50 is interposed between the maintenance wiper and capping station 24 and waste ink collection device 26, i.e., maintenance wiper and capping station 24 and waste ink collection device 26 are located on opposite sides of print zone 50.

Waste ink collection device 26 is primarily intended for the collection of pigment-based inks, but can be used for dye-based inks. In the illustrated embodiment of FIG. 1, there is shown a waste ink collection assembly 68 for collecting color ink ejected from color printhead 30, and a waste ink collection assembly 70 for collecting waste ink ejected from black printhead 32. Alternatively, through appropriate control logic for positioning printheads 30 and/or 32, a single ink collection assembly, such as waste ink collection assembly 68, could be used for either or both of printheads 30, 32 that ejects ink during the spit maintenance cycle. However, having two independent waste ink collection assemblies 68, 70 can be advantageous when one of the inks, such as the black ink, is a pigment based ink and the other ink is a dye based ink.

As shown in FIG. 1, waste ink collection assembly 68 includes a ink collection chimney 72 that is connected to a base 74. Waste ink collection assembly 70 includes an ink collection chimney 76 that is connected to a base 78. As shown in FIG. 1, ink collection chimney 72 is mechanically connected to mid-frame 22, and thus in turn, is indirectly coupled to printer frame 12, via base 74. For example, mid-frame 22 and ink collection chimney 72 may be molded as a unitary structure. Ink collection chimney 76, as shown, is mechanically coupled to printer frame 12 via base 78. While it is contemplated that other types of mechanical coupling is possible, with respect to the present invention, ink collection chimney 72 and ink collection chimney 76 are coupled to be in fixed relation to printer frame 12, and in turn, are maintained at a fixed distance from printheads 30, 32, when printhead carrier 28 is transported over waste ink collection device 26. In a preferred implementation of the invention, the clearance between ink collection chimneys 72, 76 and printheads 30, 32, respectively, is approximately 1.0 millimeters (mm).

Since each of waste ink collection assembly 68 and waste ink collection assembly 70 are substantially identical, for ease of discussion, only waste ink collection assembly 68 will be described in detail below with respect to FIGS. 2A and 2B. In addition, as mentioned above, in some implementations of the present feature only one waste ink collection assembly, such as waste ink collection assembly 68, will be used, so as to minimize costs and part count.

Figure 2A:
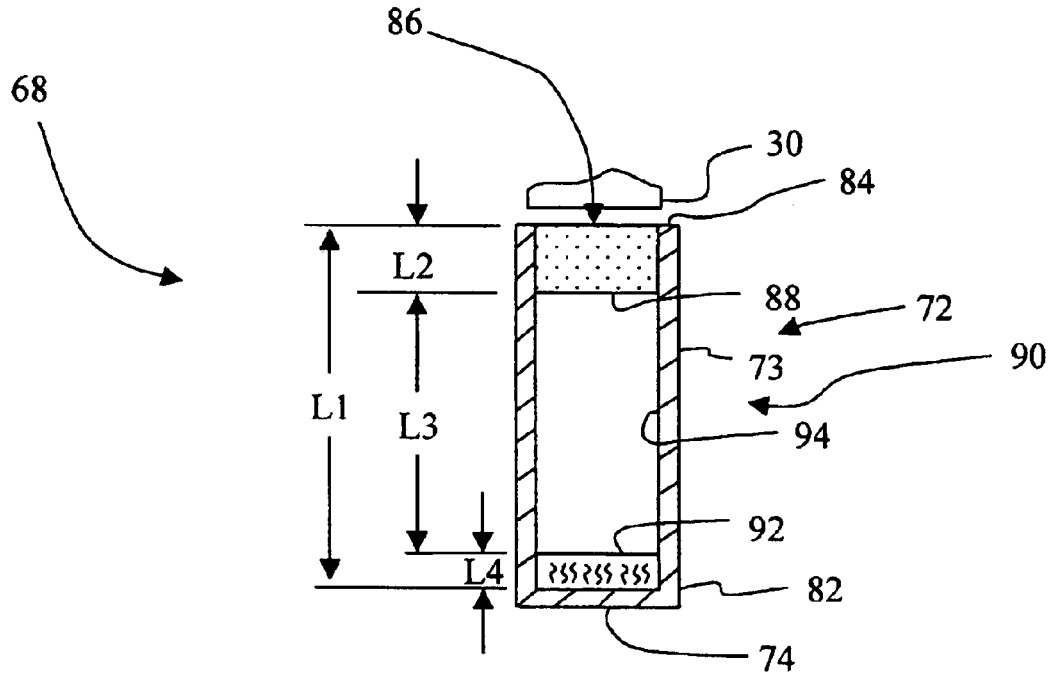
FIG. 2A is a sectioned side view of a waste ink collection assembly of FIG. 1.
Figure 2B:
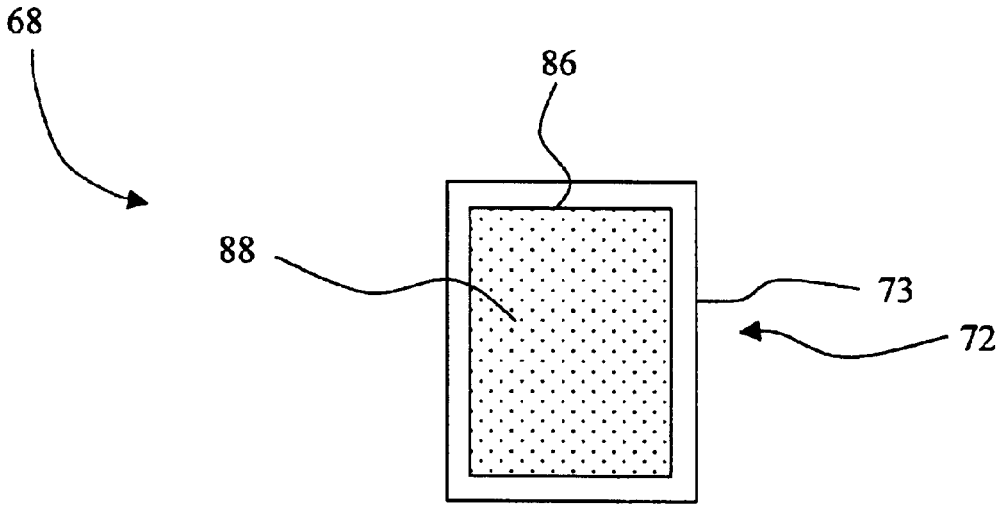
FIG. 2B is a top view of a waste ink collection assembly of FIG. 1.

FIG. 2A is a sectioned side view of waste ink collection assembly 68. FIG. 2B is a top view of waste ink collection assembly 68. From FIGS. 1, 2A and 2B, it can be seen that ink collection chimney 72 is defined by a tubular structure 73 attached to base 74. Tubular structure 73 is not limited to any particular geometric cross sectional shape, and may be, for example, a square tube, a rectangular tube, oval tube, a cylinder, etc. Characteristic of all such tubular structures, however, is its open interior.

As shown in FIG. 2A, tubular structure 73 has a proximal end 82 and a distal end 84. Tubular structure 73 extends from proximal end 82 a distance L1 to distal end 84. Proximal end 82 of tubular structure 73 is attached to base 74. Referring to FIGS. 2A and 2B, distal end 84 of ink collection chimney 72 defines an opening 86 for receiving waste ink, such as waste ink ejected from printhead 30. Opening 86 is dimensioned to be just slightly larger that the nozzle pattern of the largest printhead that ink collection chimney 72 is to accommodate, so that ink ejected from the nozzles of the printhead, such as printhead 30, will be directed into opening 86. As shown in FIG. 2B, opening 86 is substantially rectangular in shape.

Extending into tubular structure 73 a distance L2 from distal end 84 toward proximal end 82 is a hydrophobic foam 88, such as for example, a polyether foam having a porosity within a range of 10 to 40 pores per inch (ppi). In one embodiment of the invention, hydrophobic foam 88 has a porosity of 18 ppi. A hollow elongate portion 90 of tubular structure 73 has a length L3 and serves as an ink mist accumulator section. By the term "hollow" it is meant that there is substantially no intervening material between walls of the tubular structure in that portion of ink collection chimney 72. For example, hollow elongate portion 90 is substantially void of hydrophobic foam 88. An absorption pad 92, such as for example, a felt pad, is positioned adjacent proximal end 82 and extends into ink collection chimney 72 a distance L4 from proximal end 82 toward distal end 84. The optimal distances L1, L2, L3 and L4 are selected empirically to provide the least amount of back draft of ink mist out of opening 86. However, the distance L3 will be greater than zero millimeters, and more preferably, distance L3 will be at least two times that of distance L2. L2 can range from 5 to 17 millimeters (mm). L3 can range from 10 to 34 mm. L4 can range from 2 to 8 mm. L1 is the sum of L2+L3+L4. As a specific example, the distance L1 may be 20 mm, the distance L2 may be 5 mm, the distance L3 may be 13 mm and the distance L4 may be 2 mm.

During the spit maintenance operation, waste ink is spit from the nozzles of printhead 30. The waste ink ejected from printhead 30 passes through opening 86, and passes into and through hydrophobic foam 88. Hydrophobic foam 88 serves as a filter to collect and direct the ink mist into hollow elongate portion 90, and serves as a one way valve to prevent ink mist from being drafted out of opening 86 following conclusion of the spit maintenance operation as printhead carrier 28 moves away from waste ink collection device 26. Hollow elongate portion 90 of ink collection chimney 72 serves as an ink mist accumulator to accommodate the received ink mist, as the ink mist begins to form larger droplets which begin to collect on the inside surface 94 of hollow elongate portion 90 of ink collection chimney 72, which in turn drain down to absorption pad 92.

Figure 3:
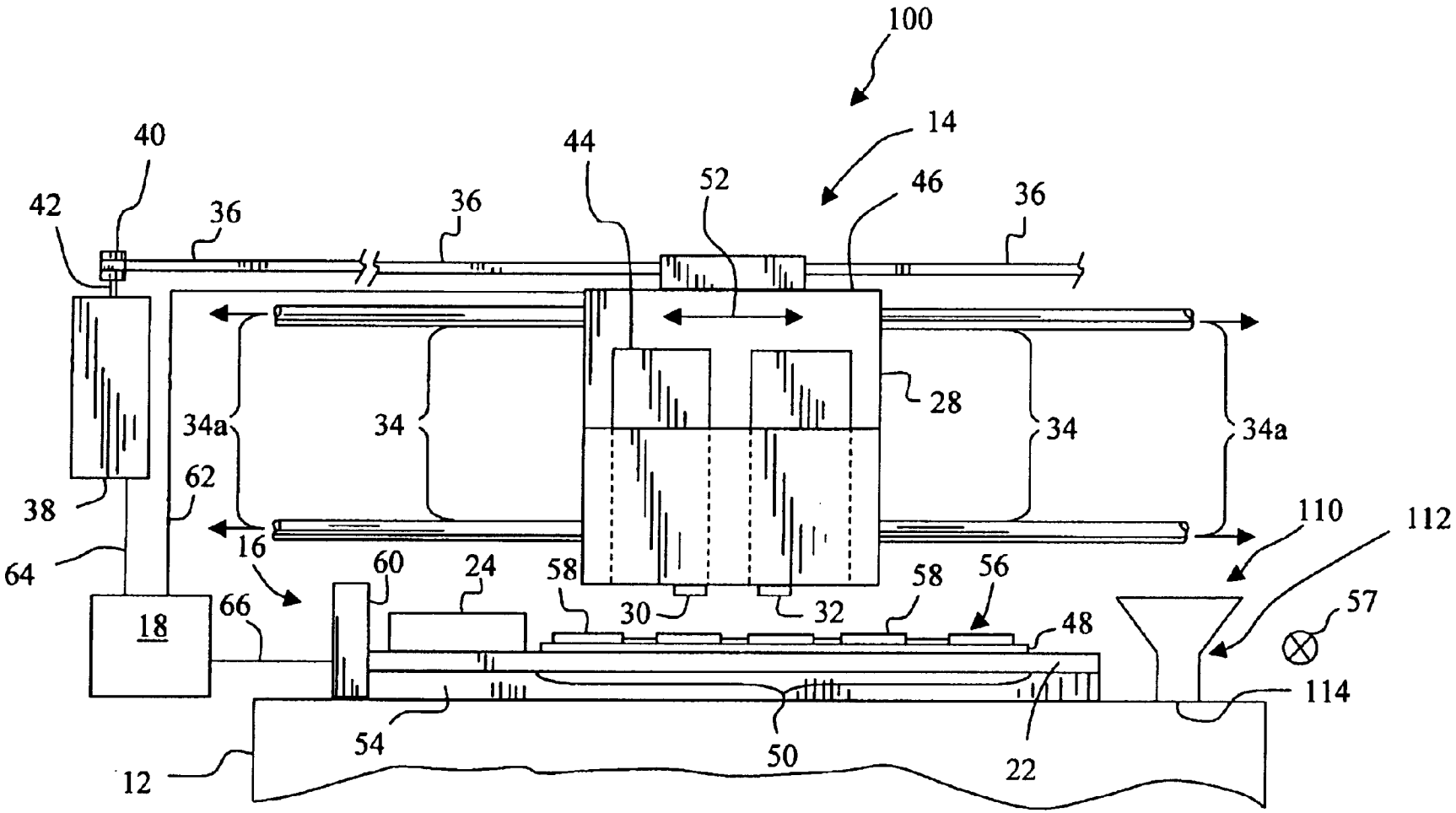
FIG. 3 is a pictorial representation of a portion of an ink jet printer including another embodiment of the present invention.

FIG. 3 shows another embodiment of the invention with respect to an ink jet printer 100. The primary difference between printer 100 and the previously described ink jet printer 10 is the inclusion of a single waste ink collection assembly 110 sized to simultaneously accommodate two printheads, such as printheads 30 and 32. As shown in FIG. 3, waste ink collection assembly 110 includes a ink collection chimney 112 that is connected to a base 114. Ink collection chimney 112 is mechanically coupled to printer frame 12 via base 114. Alternatively, ink collection chimney 112 is mechanically coupled to mid-frame 22, and thus is also indirectly coupled to printer frame 12. While it is contemplated that other types of mechanical coupling is possible, with respect to the present invention, ink collection chimney 112 is coupled so as to be in fixed relation to printer frame 12, and in turn, is maintained at a fixed distance from printheads 30 and 32 when printhead carrier 28 is transported over waste ink collection device 110. In a preferred implementation of the invention, clearance between ink collection chimney 112 and printheads 30 and 32 is approximately 1.0 mm.

Figure 4A:
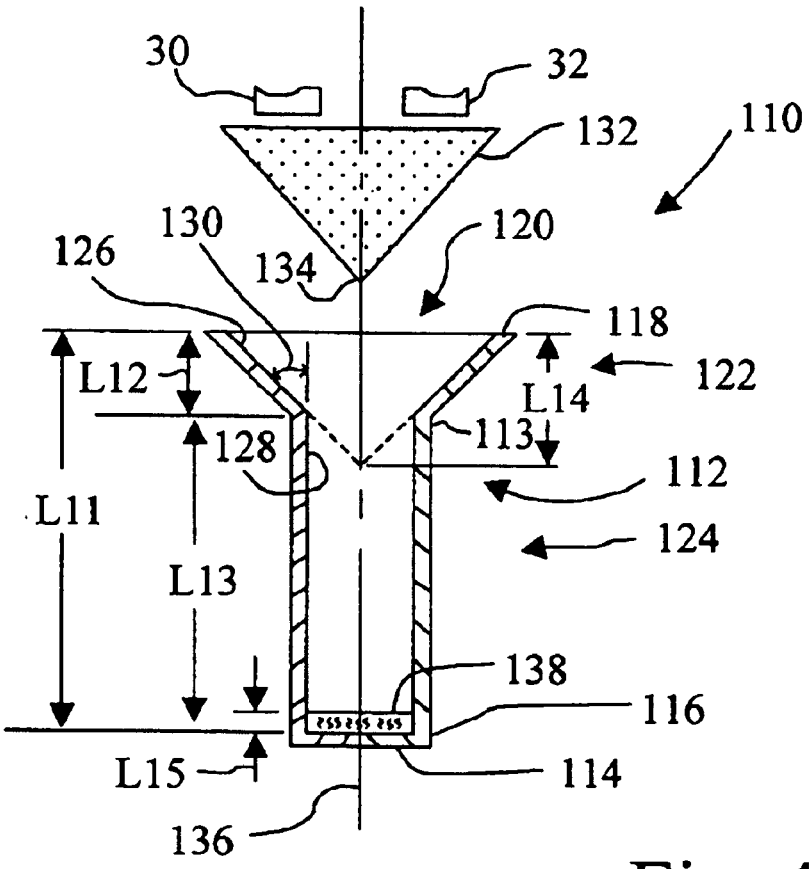
FIG. 4A is an exploded sectioned side view of a waste ink collection assembly of FIG. 3.
Figure 4B:
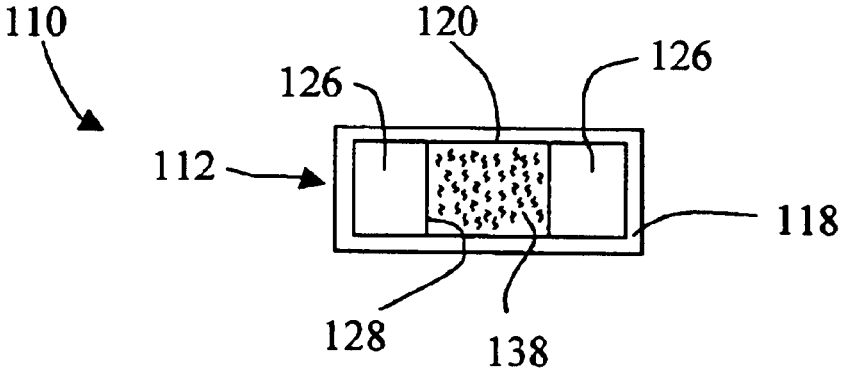
FIG. 4B is a top view of a waste ink collection assembly of FIG. 3 with the foam and felt inserts removed.

FIG. 4A is an exploded sectioned side view of waste ink collection assembly 110. FIG. 4B is a top view of waste ink collection assembly 110 with hydrophobic foam 132 removed to expose the interior thereof From FIGS. 3, 4A and 4B, it can be seen that ink collection chimney 112 is defined by an irregular shaped tubular structure 113 and a base 114. Preferably, irregular shaped tubular structure 113 has a rectangular cross section. As shown in FIG. 4A, tubular structure 113 has a proximal end 116 and a distal end 118. Tubular structure 113 extends from proximal end 116 a distance L11 to distal end 118. Proximal end 116 of tubular structure 113 is connected to base 114. Referring to FIG. 4B, distal end 118 of tubular structure 113 defines an opening 120 for receiving waste ink, such as waste ink ejected from printheads 30 and 32. Opening 120 is dimensioned to be slightly larger that the combined nozzle pattern of printheads 30 and 32, so that ink ejected from the nozzles of printheads 30 and 32 will be directed into opening 120. As shown in FIG. 4B, opening 120 is substantially rectangular in shape.

The irregular shaped tubular structure 113 includes a tapered portion 122 and a hollow elongate portion 124. Tapered portion 122 includes an inner surface 126 and hollow elongate portion 124 includes an inner surface 128. Inner surface 126 intersects inner surface 128 at an angle 130, such as for example, in the range of 30 to 60 degrees, and more preferably, at an angle of about 45 degrees. Tapered portion 122 of ink collection chimney 72 has a length L12. Hollow elongate portion 124 has a length L13 and serves as an ink mist accumulator section.

Extending into ink collection chimney 112 a distance L14 from distal end 118 toward proximal end 116 is hydrophobic foam 132, such as for example, an eighteen ppi polyether foam. As shown, hydrophobic foam 132 is wedge-shaped, i.e., has a triangular cross section, having a taper selected to match angle 130, and having a height, distance L14, that is greater than distance L12. Accordingly, when hydrophobic foam 132 is positioned in ink collection chimney 112, a tip 134 of hydrophobic foam 132 extends beyond tapered portion 122 into hollow elongate portion 124 along an axis of symmetry 136 of ink collection chimney 112.

An absorption pad 138 is positioned adjacent proximal end 116, and extends into ink collection chimney 112 a distance L15 from proximal end 116 toward distal end 118. Absorption pad 138 may be, for example, a felt pad. The optimal distances L11, L12, L13, L14 and L15 are selected empirically to provide the least amount of back draft of ink mist out of opening 120. L12 can range from 5 to 17 mm. L13 can range from 10 to 34 mm. L15 can range from 2 to 8 mm. Thus, the range of L14 will depend, in part on length L12. L11 is the sum of L12+L13+L15. However, the distance L13 will be greater than zero, and more preferably, distance L13 will be at least two times that of distance L12.

During the spit maintenance operation, waste ink is spit from the nozzles of printheads 30 and 32. The waste ink ejected from printheads 30 and 32 passes through opening 120, and passes into and through foam 132. Foam 132 serves as a filter to collect and direct the ink mist into hollow elongate portion 124, and serves as a one way valve to prevent ink mist from being drafted out of opening 120 following conclusion of the spit maintenance operation as printhead carrier 28 moves away from waste ink collection device 110. Hollow elongate portion 124 of ink collection chimney 112 serves as an ink mist accumulator to accommodate the received ink mist, and the accumulated ink mist begins to form larger droplets that collect on inner surface 128 of hollow elongate portion 124 of ink collection chimney 112, which in turn drain down to absorption pad 138.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A waste ink collection assembly, comprising:

an ink collection chimney defined, at least in part, by a tubular structure, said tubular structure having a proximal end and a distal end, said tubular structure extending from said proximal end a first distance to said distal end, said distal end defining an opening for receiving waste ink;

a hydrophobic foam positioned in said tubular structure, said hydrophobic foam configured to pass an ink mist; and with said hydrophobic foam positioned in said tubular structure, said tubular structure including a hollow portion being located between said hydrophobic foam and said proximal end.

2. The waste ink collection assembly of claim 1, wherein said hydrophobic foam is a polyether foam.

3. The waste ink collection assembly of claim 1, wherein said hollow portion serves as an ink mist accumulator section.

4. The waste ink collection assembly of claim 1, further comprising an absorption pad adjacent said proximal end of said tubular structure.

5. The waste ink collection assembly of claim 4, wherein said absorption pad is a felt pad.

6. The waste ink collection assembly of claim 1, wherein said hollow portion has a length, said length being greater than zero millimeters.

7. The waste ink collection assembly of claim 6, wherein said hydrophobic foam extends into said tubular structure a second distance, and wherein said length is at least two times that of said second distance.

8. The waste ink collection assembly of claim 1, wherein said opening is substantially rectangular.

9. The waste ink collection assembly of claim 1, wherein said opening is sized to simultaneously accommodate two independent printheads.

10. The waste ink collection assembly of claim 9, wherein said two independent printheads comprises a color printhead and a black printhead.

11. The waste ink collection assembly of claim 1, said tubular structure including a tapered portion and an elongate portion, said tapered portion having a first inner surface and said elongate portion having a second inner surface, said first inner surface intersecting said second inner surface at an angle.

12. The waste ink collection assembly of claim 11, wherein said angle is in a range of 30 to 60 degrees.

13. The waste ink collection assembly of claim 11, wherein said elongate portion is substantially hollow.

14. The waste ink collection assembly of claim 13, wherein said hydrophobic foam is wedge shaped, and wherein a tip of said hydrophobic foam extends into said elongate portion from said tapered portion.

15. An ink jet printer, comprising:

a frame;

a printhead carrier system coupled to said frame, said printhead carrier system including a printhead carrier for carrying at least one printhead;

an ink collection chimney, said ink collection chimney being defined, at least in part, by a tubular structure, said tubular structure having a proximal end and a distal end, said proximal end of said tubular structure being coupled to said frame, said tubular structure extending from said proximal end a first distance to said distal end, said distal end defining an opening for receiving waste ink from said at least one printhead;

a hydrophobic foam positioned in said tubular structure, said hydrophobic foam configured to pass an ink mist; and said tubular structure including a hollow portion being located between said hydrophobic foam and said proximal end.

16. The ink jet printer of claim 14, wherein said hydrophobic foam is a polyether foam.

17. The ink jet printer of claim 15, wherein said hollow portion serves as an ink mist accumulator section.

18. The ink jet printer of claim 15, further comprising an absorption pad adjacent said proximal end of said tubular structure.

19. The ink jet printer of claim 18, wherein said absorption pad is a felt pad.

20. The ink jet printer of claim 15, wherein said hollow portion has a length, said length having a range of 10 millimeters to 34 millimeters.

21. The ink jet printer of claim 20, wherein said hydrophobic foam extends into said tubular structure from said distal end a second distance, said length is at least two times that of said second distance.

22. The ink jet printer of claim 15, wherein said opening is substantially rectangular.

23. The ink jet printer of claim 15, wherein said opening is sized to simultaneously accommodate two independent printheads.

24. The ink jet printer of claim 23, wherein said two independent printheads comprises a color printhead and a black printhead.

25. The ink jet printer of claim 15, said tubular structure including a tapered portion and an elongate portion, said tapered portion having a first inner surface and said elongate portion having a second inner surface, said first inner surface intersecting said second inner surface at an angle.

26. The ink jet printer of claim 25, wherein said angle is in a range of 30 to 60 degrees.

27. The ink jet printer of claim 25, wherein said elongate portion is substantially hollow.

28. The ink jet printer of claim 25, wherein said hydrophobic foam is wedge shaped, and wherein a tip of said hydrophobic foam extends into said elongate portion from said tapered portion.

29. The ink jet printer of claim 15, wherein said printhead carrier transports said at least one printhead along a bi-directional scanning path to define a print zone, said ink jet printer further comprising a maintenance station for performing at least printhead wiping operations, said print zone being located between said maintenance station and said ink collection chimney.

30. The ink jet printer of claim 15, wherein said ink collection chimney is positioned stationary with respect to said frame.

31. The ink jet printer of claim 15, wherein said ink collection chimney is positioned stationary with respect to a mid-frame.

32. The ink jet printer of claim 31, wherein said printhead carrier carries a first printhead, said carrier transporting said first printhead to be positioned over said opening of said ink collection chimney during a spit maintenance operation.

33. The ink jet printer of claim 31, wherein said printhead carrier carries a first printhead and a second printhead, said carrier transporting each of said first printhead and said second printhead to be positioned over said opening of said ink collection chimney during a spit maintenance operation.

34. The ink jet printer of claim 33, wherein said first printhead and said second printhead are simultaneously positioned over said opening of said ink collection chimney during said spit maintenance operation.

35. The ink jet printer of claim 31, wherein said printhead carrier carries a first printhead and a second printhead, and further comprising a second ink collection chimney, wherein said carrier transports said first printhead over the first ink collection chimney and said carrier transports said second printhead over said second ink collection chimney, during spit maintenance operations.

36. The ink jet printer of claim 15, wherein said frame includes a mid-frame frame to which said ink collection chimney is attached.

* * * * *